US008992066B2

(12) United States Patent
Hsiao et al.

(10) Patent No.: US 8,992,066 B2
(45) Date of Patent: Mar. 31, 2015

(54) BACKLIGHT SYSTEM, BACKLIGHT SYSTEM MANUFACTURE METHOD AND PANEL DISPLAY DEVICE

(75) Inventors: Yu-chun Hsiao, Guandong (CN); Yi-cheng Kuo, Guandong (CN); Chong Huang, Guandong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 309 days.

(21) Appl. No.: 13/518,865

(22) PCT Filed: May 25, 2012

(86) PCT No.: PCT/CN2012/076038

§ 371 (c)(1),
(2), (4) Date: Jun. 22, 2012

(87) PCT Pub. No.: WO2013/174005

PCT Pub. Date: Nov. 28, 2013

(65) Prior Publication Data

US 2013/0314898 A1 Nov. 28, 2013

(51) Int. Cl.

| | |
|---|---|
| ***F21V 7/04*** | (2006.01) |
| ***G09F 13/04*** | (2006.01) |
| ***G09F 13/18*** | (2006.01) |
| ***G09F 13/22*** | (2006.01) |

(52) U.S. Cl.

CPC ..... *G09F 13/04* (2013.01); *G09F 13/18* (2013.01); *G09F 13/22* (2013.01)

USPC ..... 362/633; 362/97.1; 362/249.01; 362/362; 362/632

(58) Field of Classification Search

USPC ..... 362/97.1–97.3, 249.01–249.02, 362, 362/632–634, 800

See application file for complete search history.

(56) References Cited

U.S. PATENT DOCUMENTS 7,116,386 B2 * 10/2006 Lee et al. ..... 349/58
7,600,908 B2 * 10/2009 Chang et al. ..... 362/623

* cited by examiner

*Primary Examiner* — Anh Mai
*Assistant Examiner* — Meghan Dunwiddie
(74) *Attorney, Agent, or Firm* — Andrew C. Cheng

(57) ABSTRACT

The present invention provides a backlight system, backlight system manufacture method and panel display device. The backlight system comprises: package stent and at least a first and the second main splice elements; wherein the first main splice element has one end disposed with at least two splice parts, with each of splice parts has a structure matching a corresponding end of the second main splice element. The package stent is disposed on the first or the second main splice element. Semiconductor light source is packaged directly onto the packaged stent. The present invention can reduce material cost, mold cost and solve the heat dissipation problem of semiconductor light source.

15 Claims, 9 Drawing Sheets

BACKLIGHT SYSTEM, BACKLIGHT SYSTEM MANUFACTURE METHOD AND PANEL DISPLAY DEVICE

BACKGROUND OF THE INVENTION

1. Field of the Invention

The present invention relates to the field of displaying techniques, and in particular to a backlight system, backlight system manufacture method and panel display device.

2. The Related Arts

The known liquid crystal display device includes a front frame, a back panel and a backlight system, where the backlight system includes a back frame, reflector, light guide plate (LGP) and light set.

Currently, there are different sizes of display panel to meet the different application needs. For example, for TV, the liquid crystal panel provides the sizes of 31.5, 42, 46, 48 and 55 inches. Based on the size of the liquid crystal panel, different sizes of back frame molds must be used.

Referring to FIG. 1, FIG. 1 is a schematic view showing the structure of a back frame in a known liquid crystal displaying technique. As shown in FIG. 1, back frame 10 adopts a monolithic design, usually requires a metal stamping or plastic injection manufacture technique. Monolithic back frame 10 usually consumes a large amount of material and the cost is high. In addition, a larger stamping facility is required to manufacture large-sized back frame 10. Also, a large mold is required, and the mold usually has complicated structure, which is costly. Therefore, the cost of known back frame technique is usually high.

Besides, when adopting LED as light source, the LED is packaged onto the MCPCB, and then attached directly to back frame 10 or to the aluminum extrusion contacting back frame 10. The above approach uses more elements, and increases the element material cost. In addition, when adopting stent design to package the LED onto the stent, the heat generated by LED may not be dissipated in time so as to affect the optical effect of the liquid crystal display device.

SUMMARY OF THE INVENTION

The technical issue to be addressed by the present invention is to provide a backlight system, a backlight system manufacture method and a panel display device, so as to reduce the material cost, mold cost and solve the heat dissipation problem.

The present invention provides a panel display device, which comprises: a backlight system, the backlight system further comprising a back frame and LED light source; wherein the back frame comprising at least a first main splice element and a second main splice element; the first main splice element having one end disposed with at least two splice parts, with each of splice parts having a structure matching a corresponding end of the second main splice element; the first main splice element splicing with the corresponding end of the second main splice element through one of the splice parts; the first main splice element or the second main splice element comprising a bottom plate and a side plate extending upwards from long side of the bottom plate; the backlight system comprising a package stent, disposed on inner side of the side plate of the first main splice element or the second main splice element; number of LED light source being plural, and LED light source being packaged directly onto the package stent; the package stent being disposed with a heat dissipation layer partially or entirely.

According to preferred embodiment of the present invention, the back frame further comprises a third main splice element and a fourth main splice element; the first main splice element, the second main splice element, the third main splice element and the fourth main splice element are all of the long stripe shape, and are spliced together in a head-to-tail manner to form a surrounding rectangular main frame of the back frame.

The present invention provides a backlight system, which comprises: a back frame and semiconductor light source; wherein the back frame comprising at least a first main splice element and a second main splice element; the first main splice element having one end disposed with at least two splice parts, with each of splice parts having a structure matching a corresponding end of the second main splice element; the first main splice element splicing with the corresponding end of the second main splice element through one of the splice parts; the backlight system comprising a package stent, disposed on the first main splice element or the second main splice element; the semiconductor light source being packaged directly onto the package stent.

According to a preferred embodiment of the present invention, the package stent being disposed with a heat dissipation layer partially or entirely.

According to a preferred embodiment of the present invention, the first main splice element or the second main splice element comprising a bottom plate and a side plate extending upwards from long side of the bottom plate; and the package stent is disposed on inner side of the side plate.

According to a preferred embodiment of the present invention, the semiconductor light source is LED light source, number of LED light source is plural.

According to a preferred embodiment of the present invention, the at least two splice parts are located along the length direction of the first main splice element with separating gap between the splice parts.

According to a preferred embodiment of the present invention, the splice part is a concave part disposed on the first main splice element having a shape matching one end of the second main splice element to accommodate one end of the second main splice element.

According to a preferred embodiment of the present invention, the splice part is a concave part disposed on the first main splice element, the second main splice element has convex part disposed at corresponding location on surface, and the convex part can be embedded into the concave part to splice the first main splice element and the second main splice element.

According to a preferred embodiment of the present invention, surface of one end of the second main splice element is disposed with at least two convex parts along the length direction of the second main splice element with separating gap.

According to a preferred embodiment of the present invention, bottom of the concave part of the first main splice element is disposed with a first via hole, the second main splice element has a second via hole located at corresponding location, the back frame comprises fixed element, and the fixed element passes through the first via hole and the second via hole to splice the first main splice element and the second main splice element.

According to a preferred embodiment of the present invention, the back frame further comprises a third main splice element and a fourth main splice element; the first main splice element, the second main splice element, the third main splice element and the fourth main splice element are all of the long stripe shape, and are spliced together in a head-to-tail manner to form a surrounding rectangular main frame of the back frame.

According to a preferred embodiment of the present invention, the back frame further comprises auxiliary splice element disposed inside the main frame, the auxiliary-splice element is spliced to the main frame.

According to a preferred embodiment of the present invention, the auxiliary splice element comprises a first auxiliary splice element and a second auxiliary splice element, two ends of the first auxiliary element are spliced respectively with at least two main splice elements selected from the first main splice element, the second main splice element, the third main splice element, and the fourth main splice element; and two ends of the second auxiliary element are spliced respectively with at least two main splice elements selected from the first main splice element, the second main splice element, the third main splice element, and the fourth main splice element.

According to a preferred embodiment of the present invention, two ends of the first auxiliary splice element are spliced respectively with the first main splice element and the second main splice element, disposed adjacently, and two ends of the second auxiliary splice element are spliced respectively with the third main splice element and the fourth main splice element; alternatively, two ends of the first auxiliary splice element are spliced respectively with the first main splice element and the third main splice element, disposed adjacently, and two ends of the second auxiliary splice element are spliced respectively with the first main splice element and the third main splice element, disposed adjacently.

According to a preferred embodiment of the present invention, the back frame comprises at least a stent, detachable from and fixed to one or more selected from the first main splice element, the second main splice element, the third main splice element, the fourth main splice element, the first auxiliary splice element, and the second auxiliary splice element.

The present invention provides a backlight system manufacture method, which comprises: manufacturing at least a first main splice element and a second main splice element, wherein the first main splice element having one end disposed with at least two splice parts, with each of splice parts having a structure matching a corresponding end of the second main splice element; manufacturing a package stent, disposing the package stent to the first main splice element or to the second main splice element; packaging semiconductor light source directly onto the package stent; and after packaging the semiconductor light source, selecting one of the at least two splice parts to splice with corresponding end of the second main splice element based on size of back frame.

According to a preferred embodiment of the present invention, the method, during or after the step of manufacturing a package stent, further comprises a step of: disposing a head dissipation layer partially or entirely in corresponding packaged semiconductor light source.

According to a preferred embodiment of the present invention, the step of disposing a head dissipation layer partially or entirely in corresponding package semiconductor light source is specifically as: coating heat dissipation material partially or entirely on corresponding package semiconductor light source to form the heat dissipation layer.

According to a preferred embodiment of the present invention, when other splice part exists between splicing location on the second main splice element and adjacent end of the first main splice element, before or after the step of selecting one of the at least two splice parts to splice with corresponding end of the second main splice element based on size of back frame, the other splice parts of the first main splice element located outside of the splicing location on the second main splice element are cut off.

The efficacy of the present invention is that to be distinguished from the state of the art. The backlight system, the backlight system manufacture method and the panel display device according to the present invention, by disposing at least a first main splice element and a second main splice element, the first main splice element having one end disposed with at least two splice parts, the first main splice element splicing with corresponding end of the second main splice element through one of the splice parts, simplify the mold for back frame to reduce the cost of back frame mold, and save the material for back frame to reduce the manufacture cost of panel display device. In addition, the semiconductor light source is directly packaged onto the package stent to save the material cost.

Furthermore, the package stent is coated with heat dissipation material partially or entirely so as to solve the heat dissipation problem of semiconductor light source.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

Figure 1:
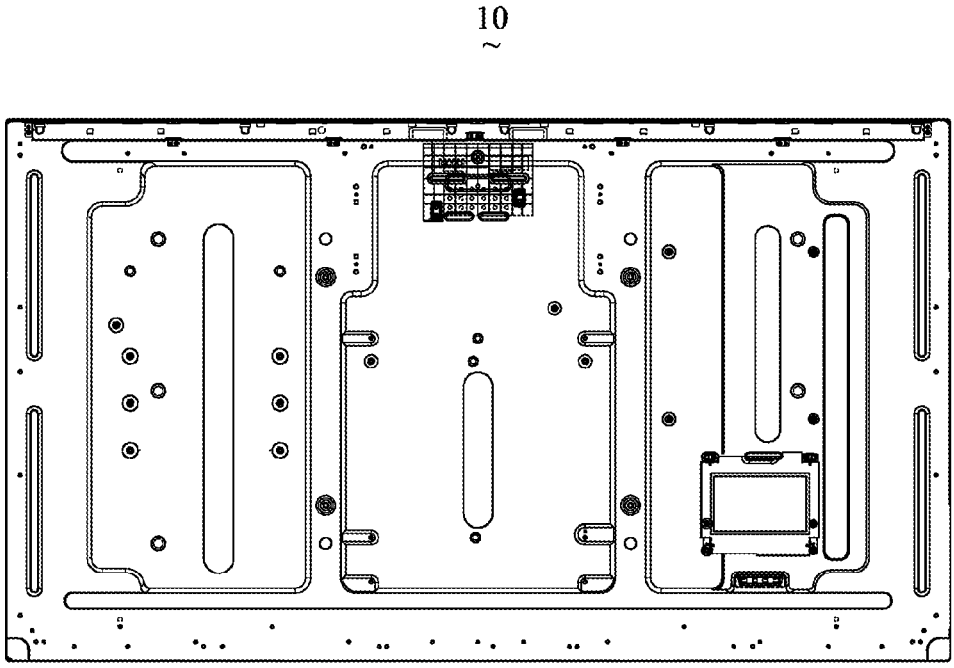
FIG. 1 is a schematic view showing the structure of a known back frame of a liquid crystal display device.

The following provides a clear and complete description of the technical solution according to the present invention using the drawing and the embodiment. Apparently, the drawings described below show only example embodiments of the present invention, instead of all embodiments. For other embodiments based on the disclosed drawings and embodiments, and obtained by those having ordinary skills in the art without paying any creative effort are also within the scope of the present invention.

Figure 2:
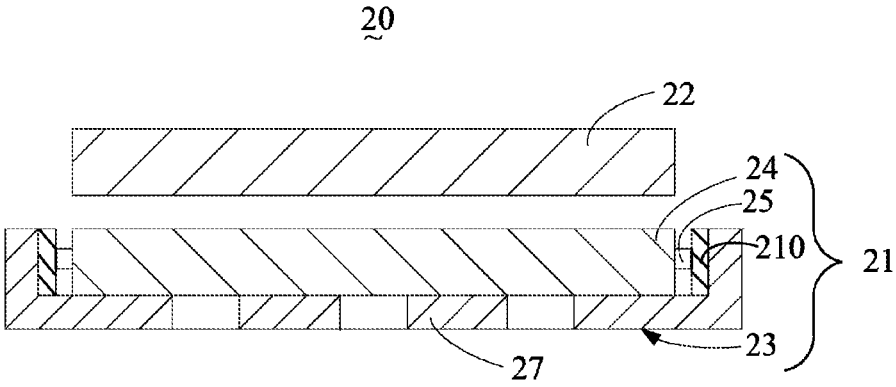
FIG. 2 is schematic view showing the structure of the panel display device of the first embodiment according to the present invention.
Figure 3:
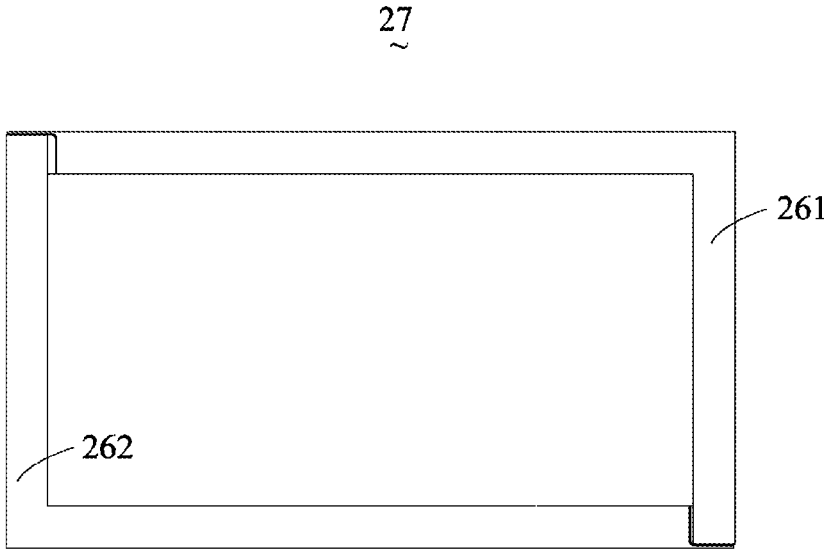
FIG. 3 is a schematic, view showing the structure of the back frame of the backlight system of the second embodiment according to the present invention.
Figure 4:
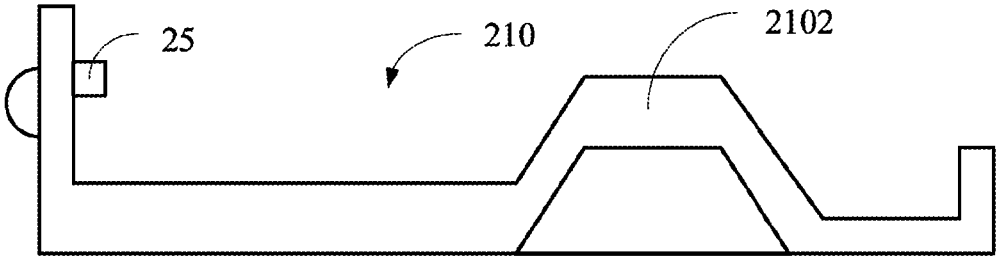
FIG. 4 is a schematic side view showing the structure of the package stent according to the present invention.

Refer to FIGS. 2-4. As shown in FIG. 2, a panel display device 20 of the present embodiment comprises: a backlight system 21 and a display panel 22. Backlight system is disposed on the back of display panel 22 and supplies light to display panel 22.

In the instant embodiment, backlight system 21 comprises semiconductor light source 25, uniform light mechanism 24, package stent 210 and back frame 23; where back frame 23 carries semiconductor light source 25 and uniform light mechanism 24. When backlight system 21 is of side-emitting type, uniform light mechanism 24 is a light guide plate (LGP). When backlight system 21 is of direct-lighting type, uniform light mechanism 24 is a diffuser. Back frame 23 comprises at least a first main splice element and a second main splice element. The first main splice element and the second main splice element form main frame 27 of back frame 23. Package stent 210 is disposed on the first main splice element or on the second main splice element. Semiconductor light source 25 is directly packaged onto package stent 210.

Also refer to FIG. 3. A first embodiment of back frame 23 comprises first main splice element 261 and second main splice element 262. One end of first main splice element 261 is spliced with one end of second main splice element 262, and the other end of first main splice element 261 is spliced with the other end of second main splice element 262 to form main frame 27 of back frame 23. First main splice element 261 and second main splice element 262 are made of aluminum or galvanized steel. In the present embodiment, first main splice element 261 and second main splice element 262 are of L shape.

Take package stent 210 disposed on first main splice element 261 as example. Package stent 210 and first main splice element 261 are manufactured separately. Then, package stent 210 is fixed to first main splice element 261. Obviously, when necessary, package stent 210 can also be detached without damage from first main splice element 261.

Package stent 210 and first main splice element 261 are connected fixedly, and one or more semiconductor light source is packaged directly onto package stent 210. In the present embodiment, first main splice element 261 comprises a bottom plate (not shown) and a side plate (not shown) extending upwards from long side of the bottom plate. Package stent 210 is connected fixedly to inner wall of the side plate. Semiconductor light source 25 is LED, and the number of LEDs can be one or more.

According to the required illumination, uniform light mechanism 24 may have different shape, the number of package stents can be one or more, and each package stent 210 is directly packaged with one or more semiconductor light source 25. For example, package stents 210 can be disposed on the same side of uniform light mechanism 24, or disposed on multiple sides of uniform light mechanism 24. Package stent 210 is restricted to any specific material, for example, package stent 210 can be made of metal, alloy or plastic.

Because semiconductor light source 25 is directly packaged onto package stent 210 and semiconductor light source 25 generates heat when operating, to dissipate the heat generated by semiconductor light source 25 in time, package stent 210 is partially or entirely disposed with a heat dissipation layer (not shown). For example, a part of the area or the entire area of package stent 210 is coated with a heat dissipation material. Furthermore, before fixing package stent 210 to first main splice element 261, a heat dissipation material can be coated into package stent 210. For example, a plurality of package stents 210 can be arranged side by side and sprayed with head dissipation material individually or altogether. Besides, to ensure the physical strength of package stent 210 to avoid accidental deformation to affect the optical effect of backlight system 21, package stent 210 can be further disposed with one or more enhancement rib 2102.

Figure 5:
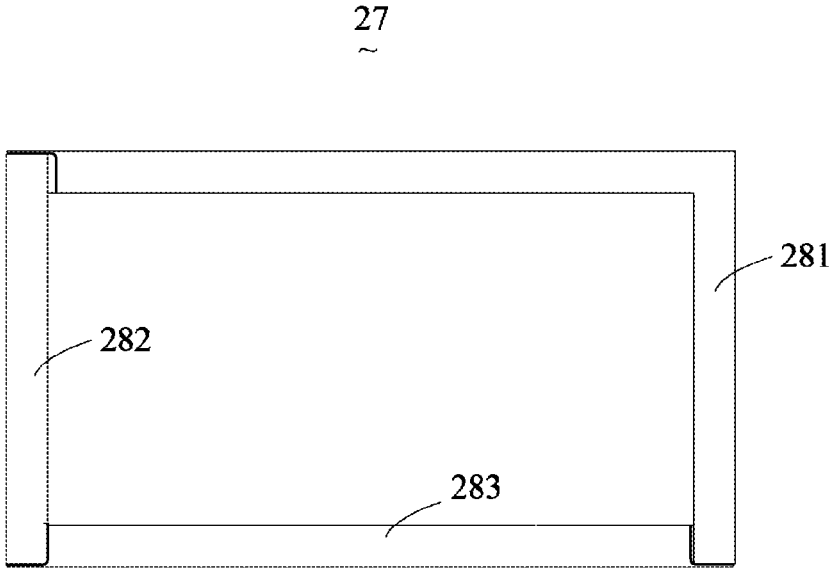
FIG. 5 is a schematic view showing the structure of the back frame of the backlight system of the third embodiment according to the present invention.

Also refer to FIG. 5. A second embodiment of back frame 23 comprises first main splice element 281, second main splice element 282, and third main splice element 283. First main splice element 281, second main splice element 282, and third main splice element 283 are spliced together to form main frame 27 of back frame 23. First main splice element 281, second main splice element 282, and third main splice element 283 are made of aluminum or galvanized steel. In the present embodiment, first main splice element 281 is of L shape, and second main splice element 282 and third main splice element 283 are both of long stripe shape. In the present embodiment, package stent can be disposed on first main splice element 281, second main splice element 282, or third main splice element 283. The structure of package stent is similar to the first embodiment, and the description will not be repeated here.

Besides, back frame 23 further comprises auxiliary splice element disposed inside main frame 27 to splice with main frame 27.

The following uses four main splice elements and two auxiliary splice elements to describe back frame 23 of backlight system 21 of the present invention in details.

Figure 6:
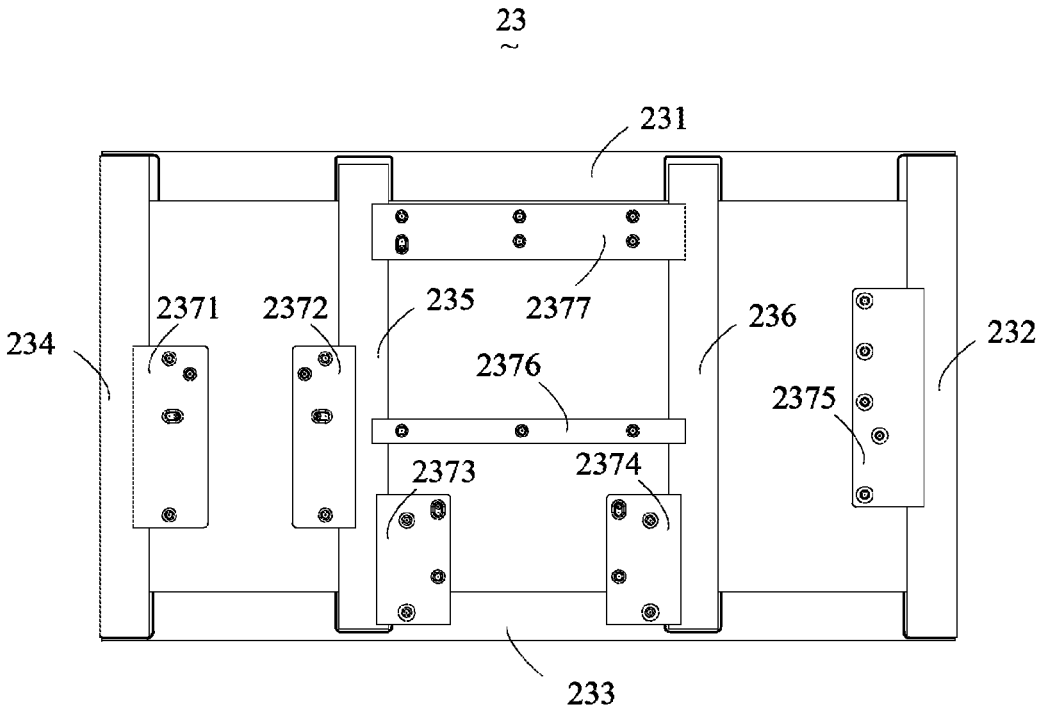
FIG. 6 is a schematic view showing the structure of the back frame of the backlight system of the fourth embodiment according to the present invention.

Referring to FIG. 6, FIG. 6 is a schematic view showing the structure of the back frame of the backlight system according to the fourth embodiment of the present invention. As shown in FIG. 6, back frame 23 in this embodiment comprises: a first main splice element 231, a second main splice element 232, a third main splice element 233, a fourth main splice element 234, a first auxiliary splice element 235, a second auxiliary splice element 236, and stents 2371, 2372, 2373, 2374, 2375, 2376, 2377. First main splice element 231, second main splice element 232, third main splice element 233 and fourth main splice element 234 are spliced together in a head-to-tail manner to form rectangular main frame 27 of back frame 23. First auxiliary splice element 235 and second splice element 236 are for assisting splicing, disposed inside main frame 27 and spliced with main frame 27. In the present embodiment, package stent can be disposed on first main splice element 231, second main splice element 232, third main splice element 233 and fourth main splice element 234. The structure of package stent is similar to the first embodiment, and the description will not be repeated here.

Specifically, one end of first main splice element 231 is spliced with one end of second main splice element 232; the other end of second main splice element 232 is spliced with one end of third main splice element 233; the other end of third main splice element 233 is spliced with one end of fourth main splice element 234; and the other end of fourth main splice element 234 is spliced with the other end of first main splice element 231 to form rectangular main frame 27; wherein first main splice element 231, second main splice element 232, third main splice element 233 and fourth main splice element 234 are all made of aluminum or galvanized steel. In the present embodiment, first main splice element 231, second main splice element 232, third main splice element 233 and fourth main splice element 234 are all of long stripe shape. In other embodiments, first main splice element 231, second main splice element 232, third main splice element 233 and fourth main splice element 234 can all be designed as L shape, or some are of long stripe shape and the rest are of L shape. For example, as shown in FIG. 3, first main splice element 261 and second main splice element 262 are both of L shape; while in FIG. 5, first main splice element 281 is of L shape, and second main splice element 282 and third main splice element 283 are of long stripe shape.

Figure 7:
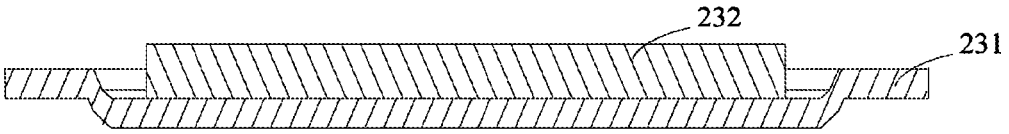
FIG. 7 is a schematic view showing the structure of the splicing manner of the backlight system of the fifth embodiment according to the present invention.

In the present embodiment, back frame 23 of backlight system 21 adopts splicing connection to splice fixedly. As shown in FIG. 7, take the one end of first main splice element 231 spliced with one end of second main splice element 232 as example. One end of second main splice element 232 is spliced with one end of first main splice element 231, for example, by screw, buckle or soldering to splice one end of second main splice element 232 to one end of first main splice element 231.

Figure 8:
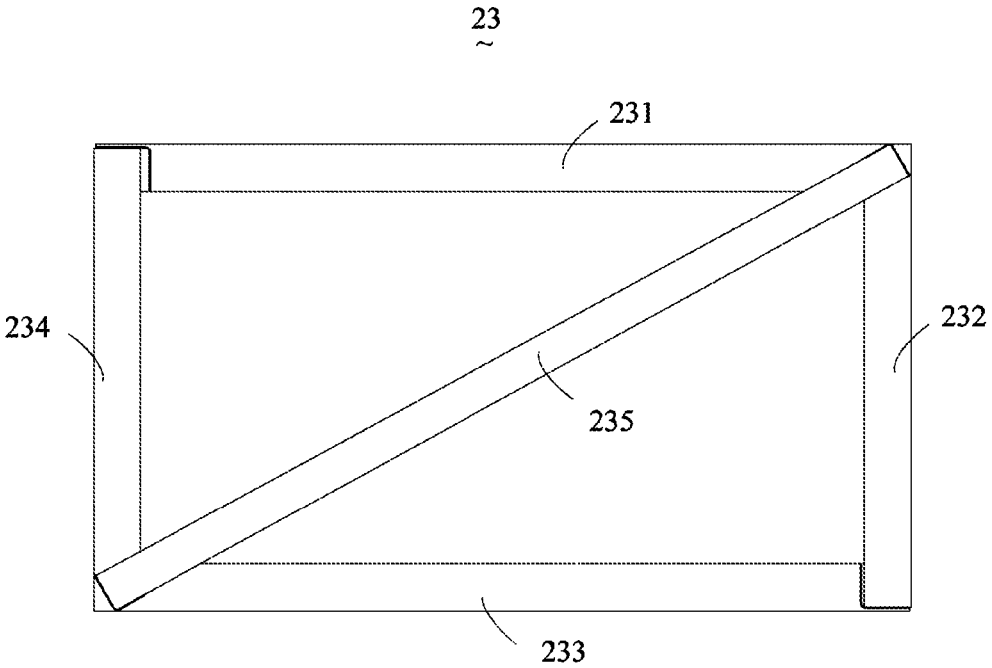
FIG. 8 is a schematic view showing the first auxiliary splice element disposed diagonally on the main frame of the backlight system of the sixth embodiment according to the present invention.
Figure 9:
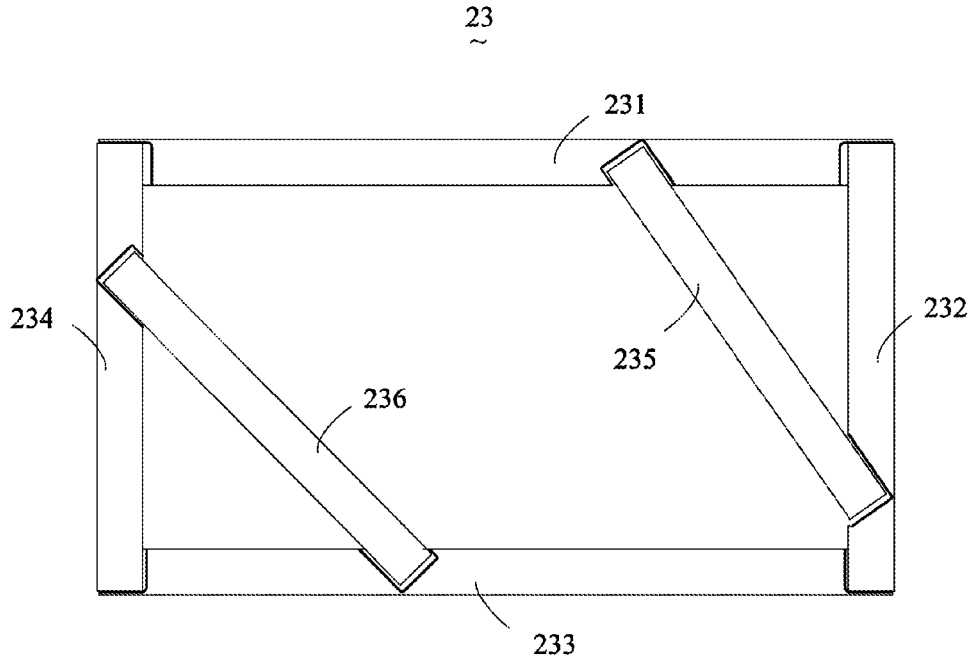
FIG. 9 is a schematic view showing the first auxiliary splice element and the second auxiliary splice element disposed diagonally on the main frame of the backlight system of the seventh embodiment according to the present invention.

In the present embodiment, first auxiliary splice element 235 and second auxiliary splice element 236 are disposed inside main frame 27 of back frame 23. One end of first auxiliary splice element 235 is spliced with first main splice element 231, and the other end of first auxiliary splice element 235 is spliced with third main splice element 233. One end of second auxiliary splice element 236 is spliced with first main splice element 231, and the other end of second auxiliary splice element 236 is spliced with third main splice element 233. Second main splice element 232, fourth main splice element 234, first auxiliary splice element 235 and second auxiliary splice element 236 are disposed in parallel. In other embodiments, at least an auxiliary splice element can be disposed inside main frame 27. For example, a first auxiliary splice element 235 is disposed inside main frame 27. In addition, two ends of first auxiliary splice element 235 are spliced with two main splice elements selected from first main splice element 231, second main splice element 232, third main splice element 233 and fourth main splice element 234. For example, first auxiliary splice element 235 is disposed diagonally inside main frame 27, as shown in FIG. 8. Similarly, two ends of second auxiliary splice element 236 are spliced with two main splice elements selected from first main splice element 231, second main splice element 232, third main splice element 233 and fourth main splice element 234. For example, two ends of first auxiliary splice element 235 are spliced with two adjacent main splice elements, i.e., first main splice element 231 and second main splice element 232, and two ends of second auxiliary splice element 236 are spliced with two adjacent main splice elements, i.e., third main splice element 233 and fourth main splice element 234, as shown in FIG. 9.

In the present embodiment, back frame 23 comprises seven stents 2371, 2372, 2373, 2374, 2375, 2376, 2377; wherein stent 2371 is fixed onto fourth main splice element 234, stents 2372, 2373 are fixed onto first auxiliary splice element 235, stent 2374 is fixed onto second auxiliary splice element 236, stent 2375 is fixed onto second main splice element 232, two ends of stents 2376, 2377 are fixed to first auxiliary splice element 235 and second auxiliary splice element 236, respectively. In fact, the stents can be fixed onto any one or more selected from first main splice element 231, second main splice element 232, third main splice element 233, fourth main splice element 234, first auxiliary splice element 235, and second auxiliary splice element 236. In other embodiments, back frame 23 can be disposed with other number of stents, such as, one or more stents. In addition, the stents can be fixed onto or detached from any one or more selected from first main splice element 231, second main splice element 232, third main splice element 233, fourth main splice element 234, first auxiliary splice element 235, and second auxiliary splice element 236.

Stents 2371, 2372, 2373, 2374, 2375, 2376, 2377 are disposed with bumps (now shown) on surface. Back frame 23 can use the bumps to fix circuit board or components.

The following describes the mold corresponding to back frame 23. In the present embodiment, first main splice element 231 and third main splice element 233 have the same size and the same shape, and can be manufactured by using the same stamping mold. Second main splice element 232 and fourth main splice element 234 have the same size and the same shape, and can be manufactured by using the same stamping mold. Thus, mold-sharing is possible. Therefore, back frame 23 of the present invention can be manufactured through stamping using two small-sized molds. Compared to the large-sized mold used in known techniques for manufacturing back frame 10, the molds for back frame 23 of the present invention are smaller in size and simpler in structure to further reduce the cost of back frame. In addition, less material is used in back frame 23 of the present invention in comparison with back frame 10 of known techniques, which results in manufacture cost of panel display device 20.

Figure 10:
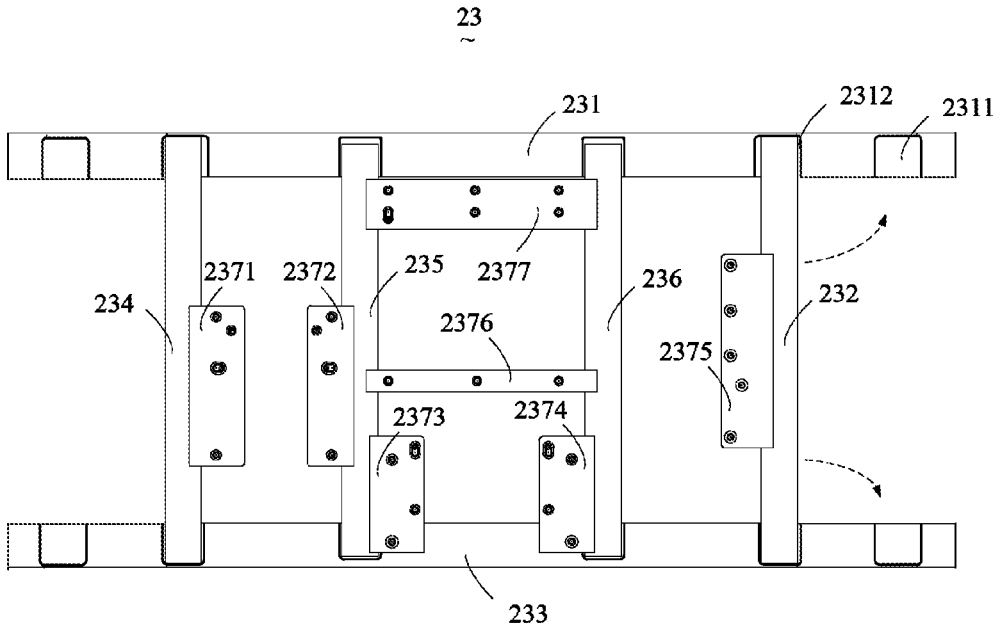
FIG. 10 is a schematic view showing the splice parts in the back frame of the backlight system of the eighth embodiment according to the present invention.

Referring to FIG. 10, FIG. 10 is a schematic view showing the splice parts in the back frame of the backlight system of the eighth embodiment according to the present invention. As shown in FIG. 10, in the present embodiment, one end of first main splice element is disposed with two splice parts. Structure of the splice parts matches one corresponding end of the second main splice element so that first main splice element can splice with second main splice element.

Figure 11:
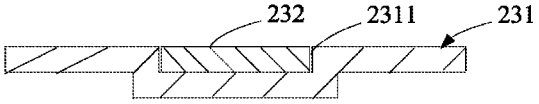
FIG. 11 is a cross-sectional view showing the first embodiment of the splice parts in FIG. 10.

Specifically, one end of first main splice element 231 is disposed with splice parts 2311, 2312. Splice parts 2311, 2312 are arranged with separating space along long side direction of first main splice element 231. Splice parts 2311, 2312 are concave parts disposed on first main splice element 231 having shape matching one end of second main splice element 232 for accommodating one end of second main splice element 232. As shown in FIG. 11, take splice part 2311 as example. Splice part 2311 is a concave part with two oppositely facing sides not penetrating one end of first main splice element 231. Shape of the concave part is rectangular. Second main splice element 232 is of a straight stripe shape.

Figure 12:
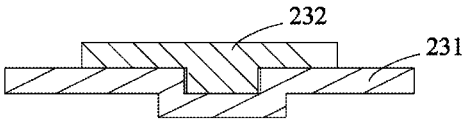
FIG. 12 is a schematic view showing the splicing manner of the splice parts in the back frame of the backlight system of the ninth embodiment according to the present invention.

When splicing for larger size back frame 23, splice part 2311 closer to end of first main splice element is selected and second main splice element 232 of corresponding width is also selected. Then, one end of second main splice element 232 is disposed onto concave part of splice part 2311. Then, using screw, buckle or soldering to fix one end of second main splice element 232 to splice part 2311. When splicing for smaller size back frame 23, splice part 2312 farther from end of first main splice element is selected and second main splice element 232 of corresponding width is also selected. Then, one end of second main splice element 232 is disposed onto concave part of splice part 2312. Then, using screw, buckle or soldering to fix one end of second main splice element 232 to splice part 2312. Specifically, for example, a convex part is disposed at the corresponding location on surface of second main splice element 232, and the convex part of second main splice element 232 is embedded into the corresponding concave part on first main splice element 231 so as to splice first main splice element 231 and second main splice element 232 together, as shown in FIG. 12. In addition, one end of second main splice element 232 can be disposed with at least two convex parts along long side direction of second main splice element 232, such as, two, three or four convex parts.

Figure 13:
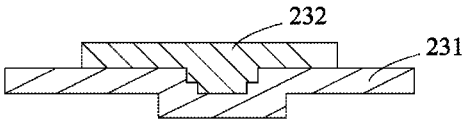
FIG. 13 is a schematic view showing the splicing manner of the splice parts in the back frame of the backlight system of the tenth embodiment according to the present invention.
Figure 14:
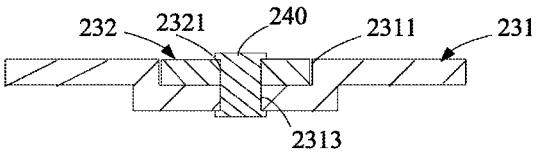
FIG. 14 is a schematic view showing the splicing manner of the splice parts in the back frame of the backlight system of the eleventh embodiment according to the present invention.

Furthermore, the concave part of first main splice element 231 can be of a multi-step structure, and convex part of second main splice element 232 can also be of a matching multi-step structure, as shown in FIG. 13. In addition, as shown in FIG. 14, take splice part 2311 as example. Bottom of concave part of first main splice element 231 is disposed with a first via hole 2313, and a second via hole 2312 is disposed at corresponding location on second main splice element 232. Back frame 23 further comprises fixed element 240. Fixed element 240 penetrates first via hole 2313 and second via hole 2321 to splice first main splice element 231 and second main splice element together.

Figure 15:
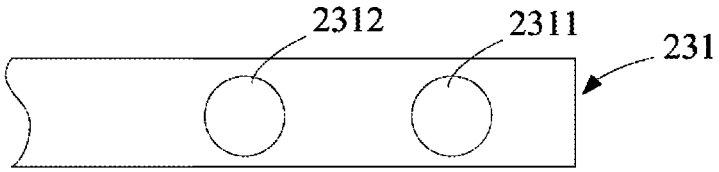
FIG. 15 is a schematic view showing the structure of the splice parts in the back frame of the backlight system of the twelfth embodiment according to the present invention.

As shown in FIG. 15, in another embodiment of the back frame of the backlight system of the present invention, splice parts 2311, 2312 of first main splice element 231 are of a round shape. However, in other embodiments, the shape of concave parts can be designed as triangular or other shapes.

Figure 16:
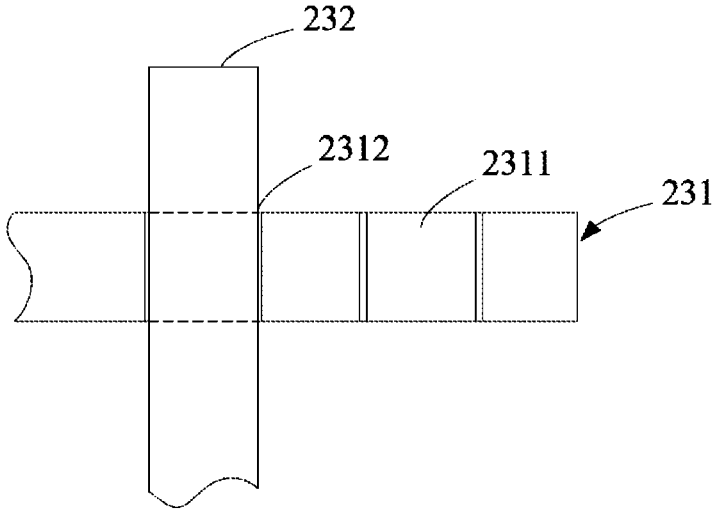
FIG. 16 is a schematic view showing the structure of the splice parts in the back frame of the backlight system of the thirteenth embodiment according to the present invention.

As shown in FIG. 16, in another embodiment of the back frame of the backlight system of the present invention, splice parts 2311, 2312 are the concave parts with two oppositely facing sides penetrating first main splice element 231 so that one end of second main splice element 232 can move on splice parts 2311, 2312. For instance, after one end of second main splice element 232 penetrates splice part 2312 and fixed together, extra part can be cut off so as to adjust length of second main splice element 232 used as a main splice element when splicing back frame 23.

In actual application, the other end of first main splice element 231 and two ends of third main splice element 233 are all disposed with two splice parts, with structure similar to splice parts 2311, 2312. Two ends of second main splice element 232 and two ends of fourth main splice element 234 can also be disposed or not disposed with, depending on different situations: for example:

(1) In the first scenario, as shown in FIG. 11, two ends of second main splice element 232 and two ends of fourth main splice element 234 can be not disposed with any design, i.e., the ends are of same structure as other parts. In such situation, when selecting different splice parts 2311 (2312) of one end of first main splice element 231 for splicing (the other end is processed similarly), if length of back frame 23 needs to be changed accordingly, lengths of the corresponding second main splice element 232 and fourth main splice element 234 must be selected accordingly. That is, if selecting splice part 2311 close to one end of first main splice element 231 for splicing, corresponding cut-off will not be performed on second main splice element 232 and fourth main splice element 234, or only a shorter part will be cut off. On the other hand, if selecting splice part 2312 farther from one end of first main splice element 231 for splicing, corresponding cut-off must be performed on second main splice element 232 and fourth main splice element 234, and cut-off lengths must be adjusted according to the distance to one end of first main splice element 231;

(2) In the second scenario, similar to the above scenario, as shown in FIG. 12. The difference is that second main splice element 232 and fourth main splice element 234 use different convex parts to match first main splice element 231 and third main splice element 233, respectively, to achieve changing width of back frame 23. Similarly, if another splice part 2312 other than splice part 2311 closest to one end of first main splice element 231 is selected for splicing, extra length of second main splice element 232 and fourth main splice element 234 must also be cut off before or after splicing.

The above scenarios are also applicable to main frame 27 of back frame 23 with splicing only two L shape main splice elements.

In summary, first main splice element of back frame 23 of the present invention is disposed with at least two splice parts, depending on the requirement to determine number of splice parts. The embodiments describe two splice parts 2311, 2312. Therefore, when disposing mold for back frame 23, only two sets of molds are required; that is, molds for first main splice element and molds for second main splice element. A plurality of splice parts are disposed on first main splice element to obtain different sizes of back frame 23. When splicing for back frame 23, respective splice part is selected according to size of back frame 23. Second main splice element is spliced to splice part of first main splice element, and extra splice part beyond splice location where first main splice element is spliced with second main splice element is cut off to obtain the required size of back frame 23. Compared to known techniques using different molds for different sizes of back frame 10, the present invention only requires molds for first main splice element for back frame 23, and molds for second main splice element 28 to achieve mold-sharing among different sizes of products. Also, the Structure of molds is simple and the mold cost is reduced.

In above embodiments, package stents can be disposed onto one or more main splice elements.

Figure 17:
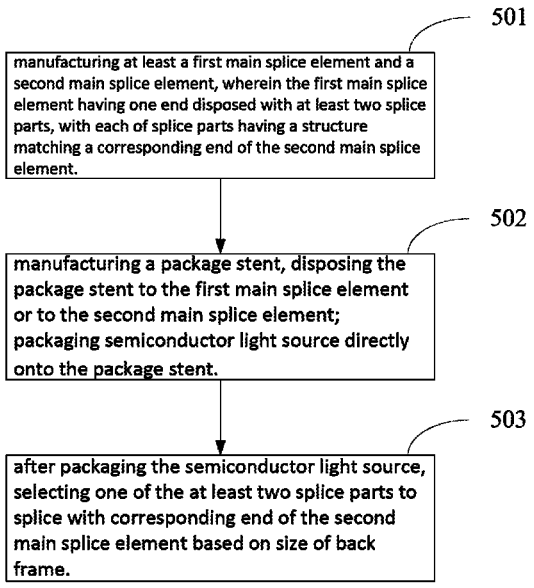
FIG. 17 shows a flowchart of a backlight system manufacture method of the fourteenth embodiment according to the present invention.

As shown in FIG. 17, the present invention further provides a backlight system manufacture method, which comprises the following steps:

Step 501: manufacturing at least a first main splice element and a second main splice element, wherein the first main splice element having one end disposed with at least two splice parts, with each of splice parts having a structure matching a corresponding end of the second main splice element.

Step 502: manufacturing a package stent, disposing the package stent to the first main splice element or to the second main splice element; packaging semiconductor light source directly onto the package stent.

Step 503: after packaging the semiconductor light source, selecting one of the at least two splice parts to splice with corresponding end of the second main splice element based on size of back frame.

In the instant embodiment, when other splice parts exist between location where second main splice element spliced with first main splice element and adjacent end of first main splice element, the extra splice parts existing between location where second main splice element spliced with first main splice element are cut off before or after the step of selecting one of the at least two splice parts to splice with corresponding end of the second main splice element based on size of back frame; wherein first main splice element is the aforementioned first main splice element and second main splice element is the aforementioned second main splice element. The description will not be repeated here.

According to a preferred embodiment of the present invention, the method, during or after the step of manufacturing a package stent, further comprises a step of: disposing a head dissipation layer partially or entirely in corresponding package semiconductor light source.

According to a preferred embodiment of the present invention, the step of disposing a head dissipation layer partially or entirely in corresponding package semiconductor light source is specifically as: coating heat dissipation material partially or entirely on corresponding package semiconductor light source to form the heat dissipation layer.

Figure 18:
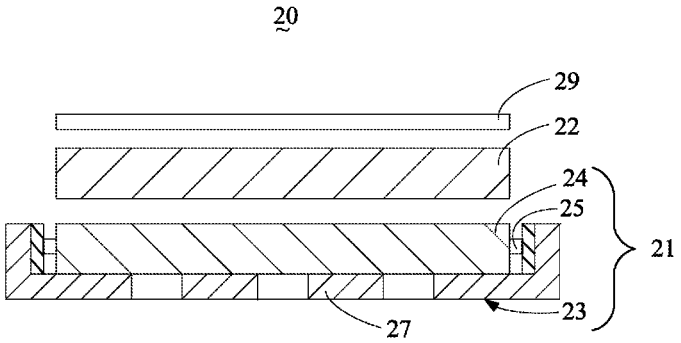
FIG. 18 is a schematic view showing the structure of panel display device having touch screen of the fifteenth embodiment according to the present invention.

As shown in FIG. 18, panel display device 20 of the present invention further comprises a touch panel 29, disposed on light-emitting surface of display panel 22 of panel display device 20; wherein panel display device 20 comprises: backlight system 21 and aforementioned display panel 22. Backlight system 21 is disposed at back of display panel 22 to supply light to display panel 22.

Backlight system 22 comprises semiconductor light source 25, uniform light mechanism 24, and back frame 23; where back frame 23 carries semiconductor light source 25 and uniform light mechanism 24. When backlight system 21 is of side-emitting type, uniform light mechanism 24 is a light guide plate (LGP). When backlight system 21 is of direct-lighting type, uniform light mechanism 24 is a diffuser. Back frame 23 comprises at least a first main splice element and a second main splice element. The first main splice element and the second main splice element form main frame 27 of back frame 23.

Obviously, backlight system 21 can also be of any structure of aforementioned embodiments of backlight system.

It should be noted that panel display device 20 of the present invention can be liquid crystal display device or liquid crystal TV.

Figure 19:
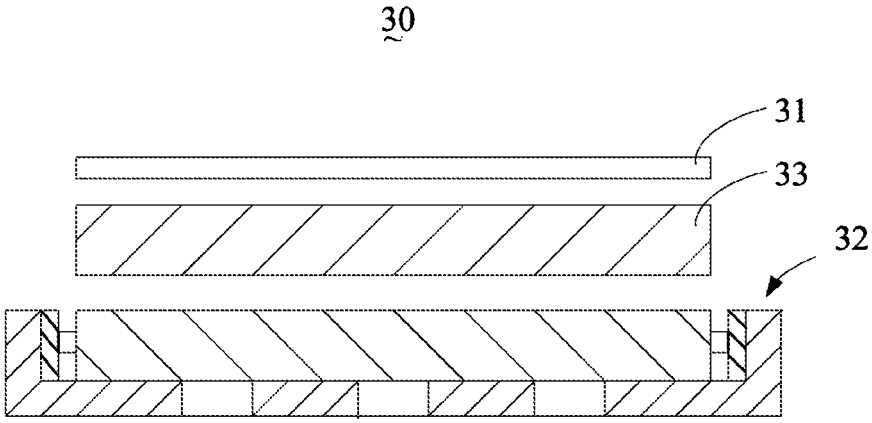
FIG. 19 is a schematic view showing the structure of 3D display device of the sixteenth embodiment according to the present invention.

The present invention further provides a 3D display device, as shown in FIG. 19. 3D display device 30 comprises liquid crystal lens grating 31, backlight system 32 and display panel 33; wherein liquid crystal lens grating 31 is disposed on light-emitting surface of display panel 33. Backlight system 32 is the backlight system in aforementioned embodiments, such as, backlight system 32 comprising back frame 23; wherein back frame 23 comprises at least a first main splice element and a second main splice element. The first main splice element and the second main splice element form main frame of back frame. Backlight system 32 can also be of any structure of aforementioned embodiments of backlight system, and the description will not be repeated here.

Figure 20:
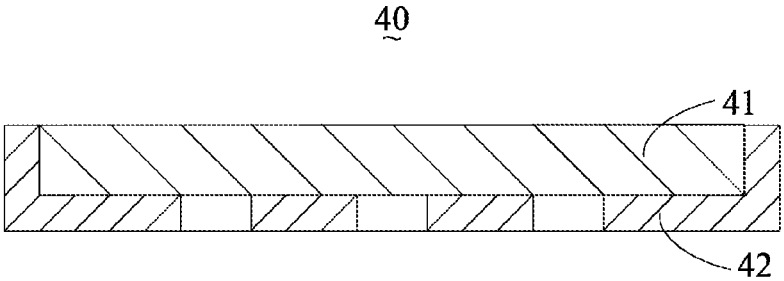
FIG. 20 is a schematic view showing the structure of plasma display device of the seventeenth embodiment according to the present invention.

The present invention further provides a plasma display device 40, as shown in FIG. 20. Plasma display device 40 comprises a plasma display panel 41 and a back frame 42. Back frame 42 is disposed at back of plasma display panel 41; wherein back frame 42 can be the back frames of any aforementioned embodiments, and the description will not be repeated here.

Through the above means, the backlight system, backlight manufacture method and panel display device of present invention can reduce material cost, mold cost and solve heat dissipation problem of semiconductor light source.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A backlight system, which comprises: a back frame and semiconductor light source; wherein:

the back frame comprising at least a first main splice element and a second main splice element; the first main splice element having one end disposed with at least two splice parts, with each of splice parts having a structure matching a corresponding end of the second main splice element; the first main splice element splicing with the corresponding end of the second main splice element through one of the splice parts;

the backlight system comprising a package stent, disposed on the first main splice element or the second main splice element; the semiconductor light source being packaged directly onto the package stent; and wherein the at least two splice parts are located along the length direction of the first main splice element with separating gap between the splice parts.

2. The backlight system as claimed in claim 1, characterized in that the splice part is a concave part disposed on the first main splice element having a shape matching one end of the second main splice element to accommodate one end of the second main splice element.

3. The backlight system as claimed in claim 1, characterized in that the splice part is a concave part disposed on the first main splice element, the second main splice element has convex part disposed at corresponding location on surface, and the convex part can be embedded into the concave part to splice the first main splice element and the second main splice element.

4. The backlight system as claimed in claim 3, characterized in that surface of one end of the second main splice element is disposed with at least two convex parts along the length direction of the second main splice element with separating gap.

5. The backlight system as claimed in claim 2, characterized in that bottom of the concave part of the first main splice element is disposed with a first via hole, the second main splice element has a second via hole located at corresponding location, the back frame comprises fixed element, and the fixed element passes through the first via hole and the second via hole to splice the first main splice element and the second main splice element.

6. The backlight system as claimed in claim 1, characterized in that the package stent being disposed with a heat dissipation layer partially or entirely.

7. The backlight system as claimed in claim 1, characterized in that the semiconductor light source is LED light source, number of LED light source is plural.

8. A backlight system, which comprises: a back frame and semiconductor light source; wherein:

the back frame comprising at least a first main splice element and a second main splice element; the first main splice element having one end disposed with at least two splice parts, with each of splice parts having a structure matching a corresponding end of the second main splice element; the first main splice element splicing with the corresponding end of the second main splice element through one of the splice parts;

the backlight system comprising a package stent, disposed on the first main splice element or the second main splice element; the semiconductor light source being packaged directly onto the package stent, wherein the back frame further comprises a third main splice element and a fourth main splice element;

the first main splice element, the second main splice element, the third main splice element and the fourth main splice element are all of the long stripe shape, and are spliced together in a head-to-tail manner to form a surrounding rectangular main frame of the back frame;

wherein the back frame further comprises auxiliary splice element disposed inside the main frame, the auxiliary splice element is spliced to the main frame.

9. The backlight system as claimed in claim 8, characterized in that:

the auxiliary splice element comprises a first auxiliary splice element and a second auxiliary splice element, two ends of the first auxiliary element are spliced respectively with at least two main splice elements selected from the first main splice element, the second main splice element, the third main splice element, and the fourth main splice element; and two ends of the second auxiliary element are spliced respectively with at least two main splice elements selected from the first main splice element, the second main splice element, the third main splice element, and the fourth main splice element.

10. The backlight system as claimed in claim 9, characterized in that two ends of the first auxiliary splice element are spliced respectively with the first main splice element and the second main splice element, disposed adjacently, and two ends of the second auxiliary splice element are spliced respectively with the third main splice element and the fourth main splice element; alternatively, two ends of the first auxiliary splice element are spliced respectively with the first main splice element and the third main splice element, disposed adjacently, and two ends of the second auxiliary splice element are spliced respectively with the first main splice element and the third main splice element, disposed adjacently.

11. The backlight system as claimed in claim 9, characterized in that the back frame comprises at least a stent, detachable from and fixed to one or more selected from the first main splice element, the second main splice element, the third main splice element, the fourth main splice element, the first auxiliary splice element, and the second auxiliary splice element.

12. A backlight system manufacture method, which comprises the steps of:

manufacturing at least a first main splice element and a second main splice element, wherein the first main splice element having one end disposed with at least two splice parts, with each of splice parts having a structure matching a corresponding end of the second main splice element;

manufacturing a package stent, disposing the package stent to the first main splice element or to the second main splice element; packaging semiconductor light source directly onto the package stent; and after packaging the semiconductor light source, selecting one of the at least two splice parts to splice with corresponding end of the second main splice element based on size of back frame;

wherein when other splice part exists between splicing location on the second main splice element and adjacent end of the first main splice element, before or after the step of selecting one of the at least two splice parts to splice with corresponding end of the second main splice element based on size of back frame, the other splice parts of the first main splice element located outside of the splicing location on the second main splice element are cut off.

13. The method as claimed in claim 12, characterized in that, during or after the step of manufacturing a package stent, further comprising a step of: disposing a head dissipation layer partially or entirely in corresponding packaged semiconductor light source.

14. The method as claimed in claim 13, characterized in that the step of disposing a head dissipation layer partially or entirely in corresponding package semiconductor light source is specifically as: coating heat dissipation material partially or entirely on corresponding package semiconductor light source to form the heat dissipation layer.

15. The backlight system as claimed in claim 6, characterized in that the first main splice element or the second main splice element comprising a bottom plate and a side plate extending upwards from long side of the bottom plate; and the package stent is disposed on inner side of the side plate.

* * * * *